US005285024A

United States Patent [19]

Rosander

[11] Patent Number: 5,285,024

[45] Date of Patent: Feb. 8, 1994

[54] MICROPHONE

[76] Inventor: Hans R. Rosander, Rönneholmsgatan 18, S-262 63 Ängelholm, Sweden

[21] Appl. No.: 746,086

[22] Filed: Aug. 12, 1991

Related U.S. Application Data

[63] Continuation of Ser. No. 363,168, Jun. 8, 1989, abandoned.

[51] Int. Cl.[5] ..... H04R 1/04; H04R 1/02; H04R 1/08

[52] U.S. Cl. ..... 181/158; 181/175; 181/242; 381/168

[58] Field of Search ..... 181/158, 175, 242, 148; 381/167-169; 264/545

[56] References Cited

U.S. PATENT DOCUMENTS

| | | | |
|---|---|---|---|
| 3,339,275 | 9/1967 | Anderson et al. | 264/545 |
| 4,065,648 | 12/1977 | Cvetko et al. | 381/168 |
| 4,726,068 | 2/1988 | Wiegel | 381/169 |
| 4,815,143 | 3/1989 | Derhaag et al. | 381/168 |

*Primary Examiner*—David M. Gray
*Assistant Examiner*—Eddie C. Lee
*Attorney, Agent, or Firm*—Burns, Doane, Swecker & Mathis

[57] ABSTRACT

A microphone, preferably of the type to be held in the hand or to be attached to a stand, includes a handle part, an intermediate part and a head part. At least the handle part is formed of two halves, each of which is symmetrical about a plane extending through the longitudinal axis of the handle part.

8 Claims, 2 Drawing Sheets

FIG. 7-CONVENTIONAL

FIG. 8-CONVENTIONAL

MICROPHONE

This application is a continuation, of application Ser. No. 07/363,168, filed Jun. 8, 1989 now abandoned.

DESCRIPTION

1. Technical field

The present invention relates to a microphone, preferably of the type to be carried by hand or be attached to a stand by means of a simple holder, and comprising a head, an intermediate part, and a handle.

The object of the present invention is to obtain a microphone which facilitates the production thereof a considerably reduced costs and which can be serviced much more readily.

Further objects of the present invention will be evident from the following.

2. Background of the invention

Microphones that are adapted to be carried by hand or to be attached to a holder/stand are known. Such microphones comprise a head which comprises the sound recording part of the microphone and an outer protecting net of metal mesh; an intermediate part, and a handle in the form of a tube-shaped cylinder being made in one piece, which cylinder comprises switches, electronics in the form of printed circuit boards and a connector for connection to an amplifier or the like via a flexible cord. During production of such microphones the connector, cords between connector and circuit boards, cords between circuit boards and sound recording head, and sound recording head are inserted as one unit, as a rule, from that end of the handle which is intended to be attached to the intermediate part and the head. The whole inner contents is pushed into the handle whereupon the intermediate part is screwed onto the handle via threads and is secured by means of so called LOCKTITE ®, a thread glue. The connector is fixed from the outside by means of a screw in the lower part of the handle. The screwing of the intermediate part to the handle means that the cords present must be wound around each other prior to the pushing into the interior of the handle in order not to be wound around each other after the assembly. The assembly further means that tightening means shall be applied simultaneously between the connector and the electronics part, and between the electronics part and the sound head. The switch must snap-in into a recess in the cylindrical tube, which can be complicated, but primarily a complication arises during disassembly.

These microphones and their production show a number of drawbacks, which means that they become very expensive and above all they will be dependent on the fact that one uses as a handle a cylindrical part that is made in one part, which is tube-shaped, at least in its interior. The construction as such means that it is difficult to push the inner part into the tube/handle, that a complicated tightening means must be applied which functions as a support for the circuit board, and further, that complicated constructions of the details are required to manage to obtain a complete housing of several parts. One can easily produce each detail in a production line of a workshop as well as manually. A casting of the handle and the intermediate part is, however, very complicated due to the tube shape and the need for large and complicated tools. Moulding is thus not defendable. From an assembly point of view this production is, as evident from above, complicated concerning the pushing of a board with its attached cords into the handle, the adjustment of a connector, net and tightenings. Thus a number of special tools are required. The electronic components must be made very complicated to allow admittance from the outside without using a special tool at service. If the microphone breaks it will be hard to enter it from a service point of view. As mentioned the handle and the intermediate parts are threaded and are glued together using a thread glue, the latter to protect against unintended disassembly of the microphone when used, one can easily damage the cords at a disassembly, and it is difficult to reassemble the microphone after repair of for example the electronic parts without admission of special tools.

As evident from above the microphones of today present considerable drawbacks and thus it has been required a more easily accessible construction.

DESCRIPTION OF THE PRESENT INVENTION

It has now surprisingly been shown possible to be able to overcome most of these above mentioned drawbacks by means of the present invention which is characterized in that at least the handle part of the microphone consists of two symmetrical halves arranged to each other in a plane through the longitudinal axis of the handle.

According to a preferred embodiment of the invention the handle part, the intermediate part, and the head part consist of two symmetric halves arranged to each other in a plane through the longitudinal axis of these parts.

By means of the present invention a simple assembly of the ingoing components is achieved in one part of the handle, whereupon the other half is mounted. Furthermore service can easily be carried out on the microphone as it is only necessary to lift one half of the handle, whereafter all will be easily available.

BRIEF DESCRIPTION OF THE DRAWINGS

The present invention will now be described more in detail with reference to the accompanying drawing, wherein FIG. 7 is a cross-sectional view of a conventional microphone through a plane along its longitudinal axis, FIG. 8 is a cross-sectional view along the line 8—8 in FIG. 7.

DETAILED DESCRIPTION OF THE PREFERRED EMBODIMENTS

Figure 1:
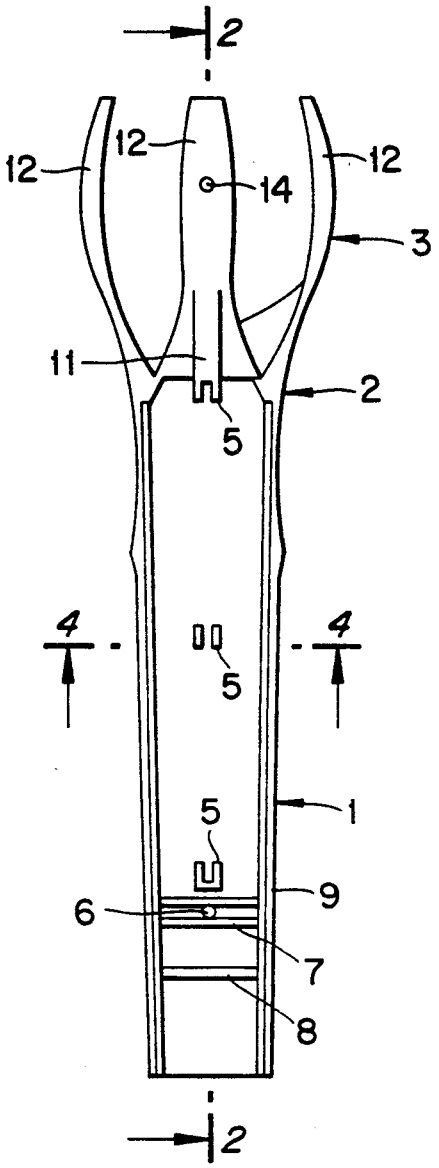
FIG. 1 is a cross-sectional view of a microphone according to the present invention.
Figure 2:
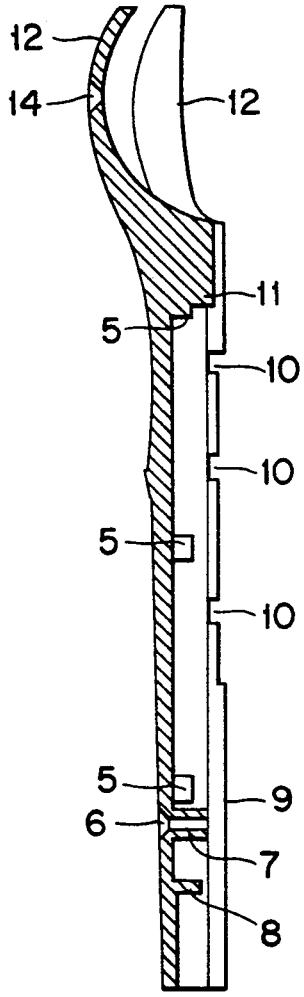
FIG. 2 is a cross-sectional view of the microphone along the line 2—2 in FIG. 1.
Figure 3:
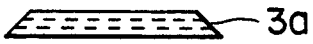
FIG. 3 is a side view of the top part of the microphone.
Figure 4:
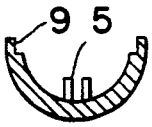
FIG. 4 is a cross-sectional view of the microphone along the line 4—4 in FIG. 1.
Figure 6:
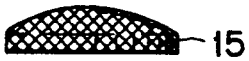
FIG. 6 is a side view of a protective net of a top part.
Figure 6:
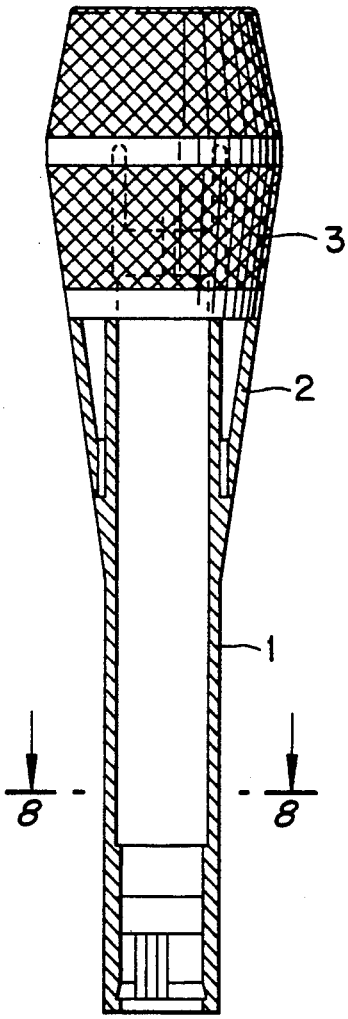
Figure 6:
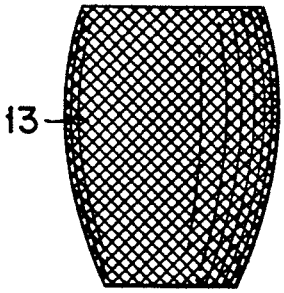
Figure 5:
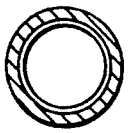
FIG. 5 is a side view of a protective net of the microphone.

In FIGS. 1, 2, and A a handle is denoted 1, an intermediate part 2 and a head part 3 with a protective net 4.

In FIGS. 1 and 2 the parts 1, 2 and 3 are integrated and prepared in one piece with the exception of the upper part 3*a* of the head part 3, which is detachable arranged to the head part 3. In the handle 1 a holder-on 5 is arranged for receiving of a circuit board (not shown). Further a throughgoing hole 6 is arranged for the assembly of two microphone halves 1 by means of a screw joint or the like to each other. In the lower part of the handle part 1 a holder 7 is arranged for receiving a tightening means (not shown) and holders 8 for receiving a connector (not shown). The outer edges 9 of the handle part and the intermediate part are provided with recesses 10 for receiving switches, indicating means, and the like. The intermediate part 2 is designed with a groove 11 for receiving a sound head (not shown) with a connection directly to the circuit board. The intermediate part 2 is designed in such a way that it tightens between the handle part 1 and the head part 3. The head part 3 comprises in the present embodiment three semi arch shaped arms 12, which are arranged to support and receive a substantially cylindrical protective net 13 fixedly arranged to the head part by means of a screw joint applied through the screw joint hole 14 arranged in one of the arms 12. Quite often the net need not be screwed but only need be held between the arms 12. On the top of the head part 3 a top 3*a* is arranged which e.g. by means of a snap coupling is arranged to the arms 12. The top part 3*a* further comprises a protective net 15 which covers and protects from above.

The recesses 10 in the limiting edges 9 of the handle halves 1 are adopted in such a way that two recesses together form a space for switches, indicating means, and other means which are fixedly attached to said circuit board, and thus only extend through said recess 10 after assembly.

During assembly the connector is mounted into its holder 8, said circuit board in its holder 5 and the sound head in its groove 11 in one symmetric half. Cords for connecting the different parts to each other are then easily placed and attached e.g. by means of simple connectors. After the mounting of these details is finished the two halves are placed against each other in a plane through their longitudinal axis and are screwed together by means of a screw placed through the hole 6 and a screw through the holes 14 in the head part 3. As the handle parts are symmetrical recesses for switches and other things are present on each side of the handle. In the case where the recesses 10 are only being used on the one side a covering plate is preferably placed over the recesses 10 not being used.

The present construction means that it is very simple to assemble all parts. They will be fit in as into an open box. It is considerably more simple to fit in the tightenings needed, particularly those between head and handle. It is also possible to produce, as shown, the handle, the intermediate part and the head part as one unit. The parts 1, 2, and 3 associated with a conventional microphone can easily be produced by moulding in comparatively simple tools. One drawback of the conventional construction is this part or parts are relatively difficult to produce manually. The construction is as evident from above can be readily cast and should also be produced in this way to be able to reduce the costs to a maxium extent. As have been evident from above the assembly is very simple and no special tools are needed either. This further means that disassembly and reassembly during servicing can be made in a simple way at each workshop in the art. A further advantage is that switches, indicating means and other means can be placed directly onto said circuit board and are thus accessible from the outside without any special tool.

As evident from FIG. A and FIG. B a conventional microphone is completely cylindrical.

I claim:

1. A microphone capable of being carried by hand or attached to a stand, comprising: a handle part located at one end of the microphone, a head part located on an opposite end of the microphone, an intermediate part located between the handle part and the head part, and means for receiving and transmitting sound, the handle part of the microphone being comprised of two handle part halves arranged with respect to each other along a plane through a longitudinal axis of the handle, the entire first handle part half being symmetrical with respect to the entire second handle part half about said plane, said intermediate part and said head part each being comprised of two symmetrical halves arranged with respect to one another along said plane, each symmetrical half of the head part comprising a plurality of semi-arch shaped arms.

2. The microphone according to claim 1, including means for removably connecting said two handle part halves to each other.

3. The microphone according to claim 1, wherein said first and second handle part halves include outer edges extending in the direction of the longitudinal axis, said outer edges of said first and second handle part halves being provided with recesses.

4. The microphone according to claim 1, wherein each symmetrical half of the head part comprises three semi-arch shaped arms.

5. A microphone capable of being held in a hand or attached to a stand, comprising: a handle part located at one end of the microphone, a head part located at an opposite end of the microphone, an intermediate part located between the handle part and the head part, and electronics for receiving and transmitting sound, said handle part having a longitudinal axis and an inner surface that receives at least a portion of the electronics, said handle part being comprised of two separate halves which are joined to one another along a plane containing the longitudinal axis, the entirety of one of said handle part halves being symmetrical with respect to the entirety of the other handle part half about said plane, each of said intermediate part and said head part being symmetrical about said plane and being comprised of two separate halves joined to one another along said plane, each separate half of the head part comprising a plurality of semi-arch shaped arms.

6. The microphone according to claim 5, including means for removably connecting said two handle part halves to each other.

7. The microphone according to claim 5, said two handle part halves include outer edges extending in the direction of the longitudinal axis, said outer edges of the two handle part halves being provided with recesses.

8. The microphone according to claim 5, wherein each separate half of said head part comprises three semi-arch shaped arms.

* * * * *

UNITED STATES PATENT AND TRADEMARK OFFICE

CERTIFICATE OF CORRECTION

PATENT NO. : 5,285,024

DATED : February 8, 1994

INVENTOR(S) : Hans R. Rosander

It is certified that error appears in the above-identified patent and that said Letters Patent is hereby corrected as shown below:

On the title page, add the following:

[30] Foreign Application Priority Data

Jun. 9, 1988 [DE] Sweden .....8802158-9

Signed and Sealed this

Fifth Day of July, 1994

*Attest:*

*Attesting Officer*

BRUCE LEHMAN

*Commissioner of Patents and Trademarks*